US006774558B2

(12) United States Patent
Otani et al.

(10) Patent No.: US 6,774,558 B2
(45) Date of Patent: Aug. 10, 2004

(54) PLASMA DISPLAY PANEL AND METHOD OF MAKING THE SAME

(75) Inventors: Mitsuhiro Otani, Osaka (JP); Masaki Aoki, Osaka (JP); Taku Watanabe, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 260 days.

(21) Appl. No.: 10/133,960

(22) Filed: Apr. 26, 2002

(65) Prior Publication Data

US 2002/0175622 A1 Nov. 28, 2002

(30) Foreign Application Priority Data

Apr. 27, 2001 (JP) ..... 2001-131412

(51) Int. Cl.[7] ..... H01J 1/90
(52) U.S. Cl. ..... 313/489; 313/587
(58) Field of Search ..... 313/489, 587, 313/485, 573, 576, 491, 635, 582, 586; 349/32

(56) References Cited

U.S. PATENT DOCUMENTS 6,097,149 A 8/2000 Miyaji et al.
6,160,345 A 12/2000 Tanaka et al.

FOREIGN PATENT DOCUMENTS

EP 0965571 12/1999
EP 1093147 4/2001

OTHER PUBLICATIONS

European Search Report for EP 02 00 9604, dated Aug. 19, 2002.

Shellby and Vitko, "Colloidal Silver Formation at the Surface of Float Glass," Journal of Non–Crystalline Solids, vol. 50, 1982, 107–117.

*Primary Examiner*—Hung Xuan Dang
(74) *Attorney, Agent, or Firm*—RatnerPrestia

(57) ABSTRACT

A glass substrate containing Na or K and being fabricated by a floating method has a surface coated with a metal oxide layer having a thermal expansion coefficient close to that of the glass substrate. Ag electrodes are provided on the metal oxide layer. This provides a plasma display panel with high image quality since the panel is prevented from migration of Ag between electrodes, thus having the glass substrate prevented from being tinted yellow. As a result, the plasma display panel at high quality can be implemented using the glass substrate.

18 Claims, 12 Drawing Sheets

FIG. 12

| Sample No. | First Metal Oxide Layer | Second Metal Oxide Layer | Method of Fabricating Metal Oxide Layer | Ag Migration, and Withstand Voltage Defects 60℃, 90%(RH), 100Hours | | Color Difference After Baking Glass | | Color Temper a-ture (° K) |
|---|---|---|---|---|---|---|---|---|
| | | | | Between Display Electrodes | Between Address Electrodes | a-Value | b-Value | |
| 1 | $Al_2O_3$ | None | Sputtering | None | None | -1.2 | 0.4 | 9,250 |
| 2 | $TiO_2$ | None | Sputtering | None | None | -2.1 | 1.0 | 9,160 |
| 3 | $ZrO_2$ | None | CVD | None | None | -2.5 | -0.6 | 9,300 |
| 4 | $Nb_2O_3$ | None | CVD | None | None | -1.9 | -0.5 | 9,350 |
| 5 | $BaSnO_3$ | None | CVD | None | None | -2.2 | -0.6 | 9,410 |
| 6 | $SnO_2$ | None | Sputtering | None | None | -2.0 | -0.5 | 9,340 |
| 7 | $Sb_2O_3$ | None | Dip Coating | None | None | -2.2 | -0.3 | 9,300 |
| 8 | $In_2O_3$ | None | Sputtering | None | None | -3.0 | 0.5 | 9,130 |
| 9 | $H_5O_2$ | None | Sputtering | None | None | -2.0 | 0.4 | 9,150 |
| 10 | $Ta_2O_5$ | None | Sputtering | None | None | -1.8 | -0.5 | 9,320 |
| 11 | ZnO | None | Sputtering | None | None | -1.8 | 1.0 | 9,100 |
| 12 | $SnTiO_4$ | None | Sputtering | None | None | -2.6 | -0.5 | 9,290 |
| 13 | $MgSnO_3$ | None | Sputtering | None | None | -2.0 | -0.4 | 9,350 |
| 14 | $CaSnO_3$ | None | Sputtering | None | None | -2.4 | -0.8 | 9,380 |
| 15 | $SrSnO_3$ | None | Sputtering | None | None | -1.5 | -0.3 | 9,390 |
| 16* | $SiO_2$ | None | Sputtering | Yes | Yes | -2.0 | 5.5 | 7,250 |
| 17 | $Al_2O_3$ | $SiO_2$ | Sputtering | None | None | -1.4 | -0.5 | 9,340 |
| 18 | $TiO_2$ | $SiO_2$ | Sputtering | None | None | -2.6 | -1.5 | 9,400 |
| 19 | $ZrO_2$ | $SiO_2$ | CVD | None | None | -2.4 | -1.6 | 9,500 |
| 20 | $Nb_2O_3$ | $SiO_2$ | CVD | None | None | -1.8 | -0.4 | 9,230 |
| 21 | $BaSnO_3$ | $SiO_2$ | CVD | None | None | -2.0 | -0.6 | 9,280 |
| 22 | $SnO_2$ | $SiO_2$ | Sputtering | None | None | -2.8 | -1.5 | 9,390 |
| 23 | $Sb_2O_3$ | $SiO_2$ | Dip Coating | None | None | -2.4 | -0.4 | 9,280 |
| 24 | $In_2O_3$ | $SiO_2$ | Sputtering | None | None | -2.9 | -0.5 | 9,260 |
| 25 | $H_5O_2$ | $SiO_2$ | Sputtering | None | None | -2.4 | -0.6 | 9,265 |
| 26 | $Ta_2O_5$ | $SiO_2$ | Sputtering | None | None | -2.7 | -0.5 | 9,222 |
| 27 | ZnO | $SiO_2$ | Sputtering | None | None | -1.8 | -0.4 | 9,150 |
| 28 | $SnTiO_4$ | $Al_2O_3$ | Sputtering | None | None | -2.2 | -1.5 | 9,335 |
| 29 | $MgSnO_3$ | $Al_2O_3$ | Sputtering | None | None | -1.8 | -1.4 | 9,370 |
| 30 | $CaSnO_3$ | $Al_2O_3$ | Sputtering | None | None | -2.3 | -1.6 | 9,420 |
| 31 | $SrSnO_3$ | $Al_2O_3$ | Sputtering | None | None | -1.9 | -1.3 | 9,390 |
| 32* | None | None | Sputtering | Yes | Yes | -2.0 | 16.3 | 6,450 |

*Samples 16 and 32 Are comparative Example

PLASMA DISPLAY PANEL AND METHOD OF MAKING THE SAME

FIELD OF THE INVENTION

The present invention relates to a plasma display panel (PDP) used in a display device and a method of making the panel.

BACKGROUND OF THE INVENTION

High-definition, large-screen television (TV) receivers such as high-definition TV have widely been demanded. Cathode ray tubes (CRT) are more favorable in resolution and quality of images than plasma displays or liquid crystal displays but not in its depth or its weight particularly for a large-screen type, 40 inches or larger. The liquid crystal displays successfully have a low power consumption and accepts a low driving voltage, but hardly have a large screen size and a wide viewing angle. The screen size of plasma displays increases to a greater size as 40 inches (for example, in page 7 of "Functional Materials", in Vol. 16, No. 2, February 1996).

A conventional plasma display panel (PDP) and a display apparatus with the PDP will be described with referring to FIGS. 7 to 10.

FIG. 7 is a partial cross sectional perspective view of an image display region of the PDP. FIG. 8 is a schematic plan view of the PDP with a front glass substrate removed, where display electrodes, display scan electrodes, and address electrode are illustrated not completely for ease of the description. An arrangement of the PDP will be explained referring to the drawings.

As shown in FIGS. 7 and 8, the PDP 100 includes a front glass substrate 101 and a back glass substrate 102 both made of boron-silicon-sodium glass by a floating method.

The front glass substrate 101 has N display electrodes 103 and N display scan electrodes 104(1) to 104(N) provided thereon. The display electrodes 103 and the display scan electrodes 104(1) to 104(N) are covered with a dielectric glass layer 103 and a protective layer 106 made of MgO, thus providing a front panel.

The back glass substrate 102 has M address electrodes 107(1) to 107(M) provided thereon. The address electrodes 107(1) to 107(M) are covered with a dielectric glass layer 108 and barriers 109. Phosphor layers 110R, 110G, and 110B are provided between the barriers 109, thus providing a back panel.

The front panel and the back panel are bonded to each other by an air-tight sealing layer 121 which extends along the edges of the panels for sealing. A discharging space 122 is developed between the front panel and the back panel, and is filled with discharge gas. The electrodes 103, 104(1) to 104(N), and 107(1) to 107(M) of the PDP are arranged in matrix pattern where a discharge cell is formed at each intersection between the scan electrode 104 and the address electrode 107.

The electrodes of the front panel may generally includes transparent electrodes 111 and silver electrodes 112 on the front glass substrate 101, or silver electrodes 113 on the front glass substrate 101 as shown in FIGS. 9A and 9B, respectively. The display apparatus having the PDP 100 of the above arrangement includes a driver 135 which includes a display driver 131, a display scan driver 132, and an address driver 133 which are connected to the corresponding electrodes of the PDP 100, and a controller 134 for controlling their operation. As being controlled by the controller 134, the drivers apply specific wave voltages between the display scan electrodes 104 and the address electrodes 107(1) to 107(M) for generating preliminary discharge at each discharge cell. Then, a pulse voltage is applied between the display electrodes 103 and the display scan electrode 104 for producing a main discharge which emits ultraviolet light at the discharge cell. The ultraviolet light excites the phosphor layer to light them. Since lighting, the discharge cells create an image in combination with not-lighted discharge cells.

The conventional PDP panel however includes the silver (Ag) electrodes where Ag may often migrate to the opposite electrodes (particularly under a high-temperature, high-moisture condition) when being energized, hence causing a short-circuit or a current leakage between terminals. It is well known that the migration of Ag under a high-temperature, high-moisture condition is accelerated when the front and back glass substrates are made of a float glass containing weight 3 to 15% of sodium (Na) or potassium (K).

FIGS. 11A and 11B illustrate electrode leads of the conventional PDP.

In a PDP of a NTSC (VGA) type shown in FIG. 11, a distance between the address electrodes 107(1) and 107(2) is substantially 160 $\mu$m while a distance between the display scan electrodes 104(1) and 104(2) is substantially 500 $\mu$m. High resolution PDPs for high-definition TV or SXGA format have a distance between any two adjacent electrodes being ½ that of the NTSC (VGA) format type. Accordingly, the intensity of an electric field between the electrodes is doubled, and the migration of Ag takes place more often in the high-definition PDP.

In addition to the Ag-migration, the float glass substrates may cause Ag to be dispersed, as Ag ion, into the substrate material or dielectric material during the baking of the Ag electrodes or the baking of the dielectric glass layers. The dispersed Ag ion can be reduced by tin (Sn) or sodium (Na) ion in the glass substrates and Na or lead (Pb) ion in the dielectric glass and thus is deposited as colloidal particles. The Ag colloidal deposition may tint the glass with yellowish color (as depicted in J. E. Shelby and J. Vitko Jr., "Journal of Non Crystalline Solids", Vol. 150 (1982), pp. 107–117), hence deteriorating a quality of an image on the panel. The yellowish Ag colloidal deposition, absorbing light of a wavelength of 400 nm, declines a luminance and a chrominance of blue color hence lowering a color temperature of the panel.

For elimination of the Ag-migration and the yellowish deposition, a technique where the sodium contained float glass with an $SiO_2$ film is coated is proposed. However, since having a thermal expansion coefficient of $4.5\times10^{-6}$(1/° C.), which is smaller than that of the float glass of $8.0\times10^{-6}$(1/° C.), the SiO2 film may create cracks after the baking process. This technique is thus imperfect for eliminating the Ag-migration and the yellowish deposition. In particular, the technique is less applicable to any high-definition display panel of the high-vision format or the SXGA format.

SUMMARY OF THE INVENTION

A plasma display panel (PDP) includes a first panel having a glass substrate fabricated by a floating method and a metal oxide layer provided on said glass substrate, a second panel facing said first panel to form a discharge space between said first panel, and an electrode containing Ag provided on said first panel.

As being prevented from a migration of Ag thus reducing a yellowish color change, the PDP can be improved in both luminance and image quality.

BRIEF DESCRIPTION OF THE DRAWINGS

FIG. 12 is a table showing characteristics of the PDP according to the embodiment.

DETAILED DESCRIPTION OF THE PREFERRED EMBODIMENTS

Figure 1A:
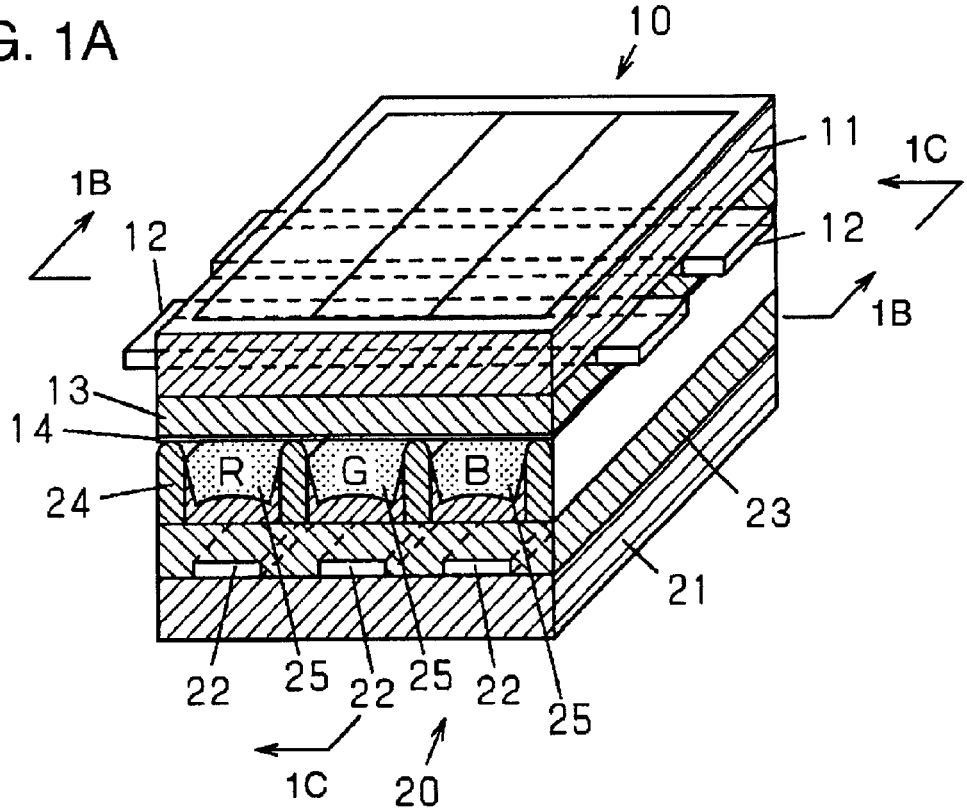
FIG. 1A is a perspective view of a primary part of a plasma display panel (PDP) according to an exemplary embodiment of the present invention.
Figure 1B:
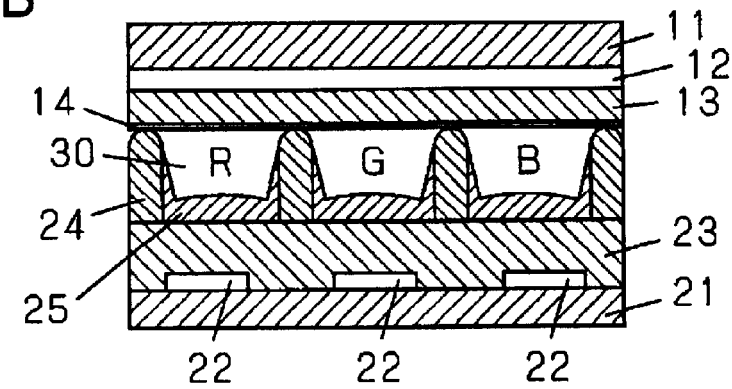
FIG. 1B is a cross sectional view taken along a line 1B—1B of FIG. 1A of the PDP according to the embodiment.
Figure 1C:
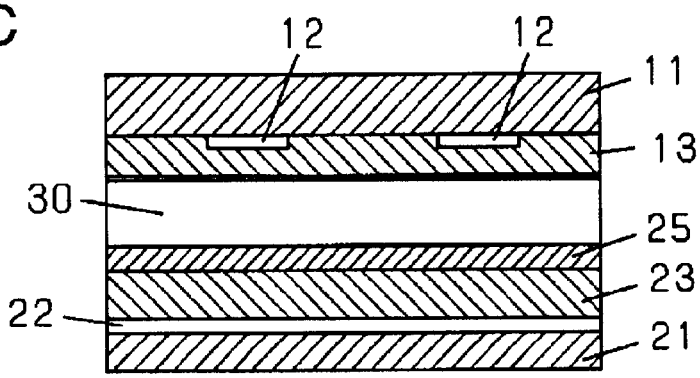
FIG. 1C is a cross sectional view taken along the line 1C—1C of FIG. 1A of the PDP according to the embodiment.

FIG. 1A is a perspective view of a primary part of an AC type plasma display panel (PDP) according to an exemplary embodiment of the present invention. FIGS. 1B and 1C illustrate discharge electrodes of the PDP in detail. FIG. 1B is a cross sectional view of the PDP taken along a line 1B—1B of FIG. 1A, and FIG. 1C is a cross sectional view of the PDP taken along a line 1C—1C of FIG. 1A. While the above drawings illustrated three cells for simplicity, the PDP has a lot of cells emitting three primary colors: red (R), green (G), and blue (B).

The PDP of this embodiment shown in FIGS. 1A to 1C includes a front panel 10 and a back panel 20 joined to each other to develop a discharging space 30 therebetween which is filled with discharge gas.

The front panel 10 having discharge electrodes 12, each including a pair of a scan electrode and a maintain electrode which form a discharge gap therebetween on a front glass substrate 11, a front cover plate, fabricated by a floating method, and has a surface coated with a metal oxide layer (not shown). The discharge electrodes 12 are covered with a dielectric glass layer 13 of dielectric glass material which has been baked after being applied in a paste form by a die coating or blade coating technique. The dielectric glass layer 13 is then coated with a protective layer 14 of magnesium oxide. The scan electrode and the maintain electrode of the discharge electrode 12 may be a transparent electrode of indium tin oxide (ITO) and a bus electrode containing Ag having a low resistance for energizing the transparent electrode, respectively. These electrodes form the discharge gap therebetween, The back panel 20 has address electrodes 22 made of metal containing at least Ag and provided on a back glass substrate 21, a back plate, which is fabricated by a floating method and has a surface coated with a metal oxide film (not shown). The address electrode 22 crosses over the discharge electrodes 12 and is covered with a dielectric glass layer 23 formed similarly to the dielectric glass layer 13. Barriers 24 are provided between the electrodes 22 for dividing the discharge space 30 into a number of cells. Phosphor layer 25 of R, G, and B colors is provided between the barriers 24.

Discharge cells are provided at each intersection of the discharge electrodes 12 and the address electrodes 22 as defined by the barriers 24 between the front panel 10 and the back panel 20.

A method of making the PDP of the above arrangement will be described in detail. A method of fabricating the front panel 10 will be described first.

As described previously, the front panel 10 has the front glass substrate 11 fabricated by a floating method coated with a metal oxide film. Then, the discharge electrodes 12 are provided on the front glass substrate 11. The discharge electrodes 12 are then covered with the dielectric glass layer 13 made of powder of glass having a softening temperature not higher than 600° C. The layer 13 is coated with the protective layer 14 of magnesium oxide.

The metal oxide film is deposited by any of the three following methods on the front glass substrate 11 by the floating method.

(1) Sputtering Method

Figure 2:
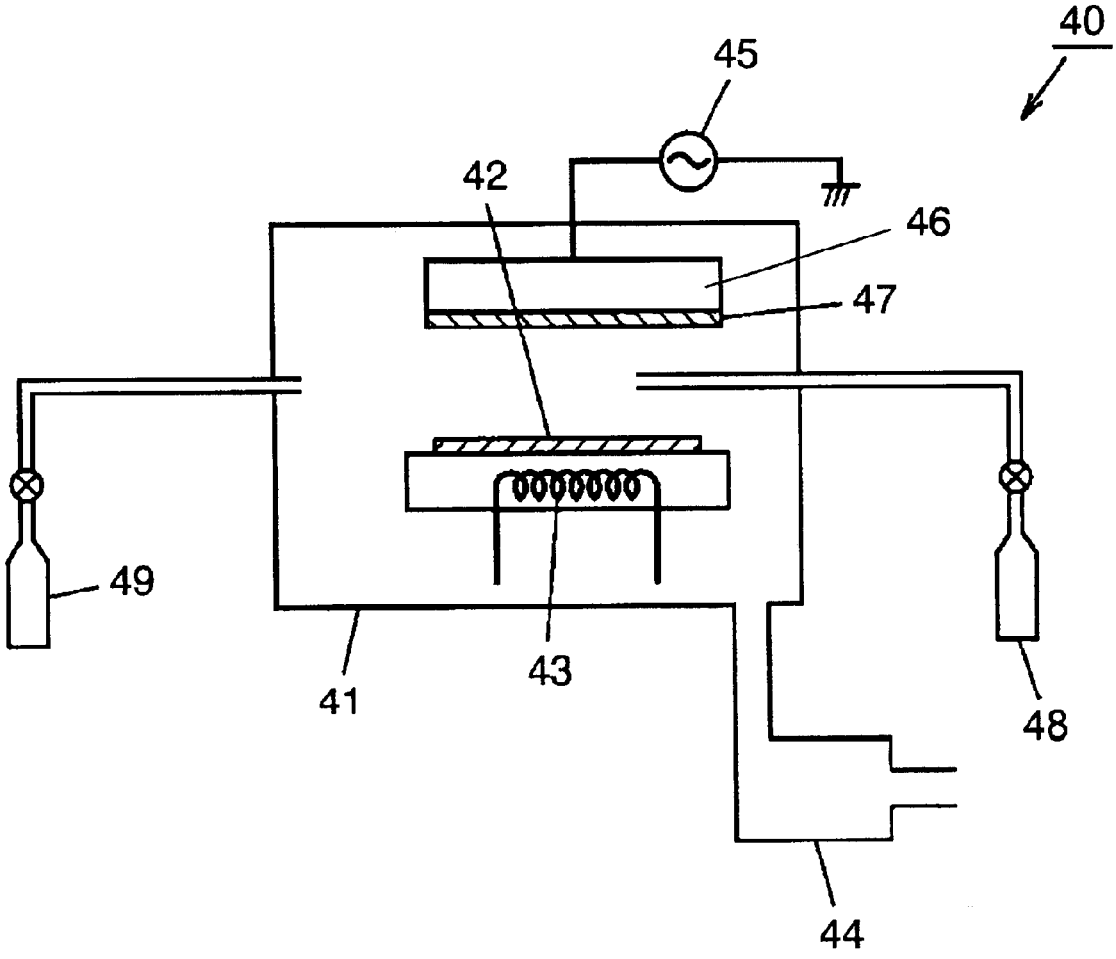
FIG. 2 is a schematic view of a sputtering apparatus for fabricating the PDP according to the embodiment.

FIG. 2 is a schematic view of a sputtering apparatus for forming a metal oxide film on the float glass substrate containing alkali components. The sputtering apparatus 40 includes a heater 43, being provided in a main sputtering chamber 41, for heating a glass substrate 42 (the front glass substrate 11 shown in FIG. 1A). The main sputtering chamber 41 is depressurized by an exhausting device 44. An electrode 46 connected to a high-frequency power source 45 is provided in the main sputtering chamber 41 for producing plasma. A target 47 of oxide (e.g. $TiO_2$, $Al_2O_3$, $Nb_2O_5$, $BaSnO_3$, $SnO_2$, $Sb_2O_3$, $In_2O_3$, $SnTiO_4$, or $SnSiO_2$) for developing the metal oxide is provided in the chamber.

An argon (Ar) gas container supplies sputtering Ar gas into the main sputtering chamber 41. An oxygen ($O_2$) gas container 49 supplies reacting gas of $O_2$ to the main sputtering chamber 41.

The sputtering apparatus starts its sputtering operation with placing the glass substrate 42 with its dielectric layer side up on the heater 43. The glass substrate 42 is heated up to a predetermined temperature (250° C.) while the main chamber 41 is depressurized to substantially $10^{-2}$ Pa by the exhausting device 44. Then the main sputtering chamber 41 is filled with the Ar gas and excited with a high-frequency electric field of 13.56 MHz generated by the high-frequency power source 45. As a result, the sputtering of the metal oxide develops the metal oxide film on the glass substrate 42 in the main sputtering chamber 41. According to the embodiment, the metal oxide film is formed by the sputtering to have a thickness ranging from 0.05 to 1 $\mu$m.

(2) Chemical Vapor Deposition (CVD) Method

Figure 3:
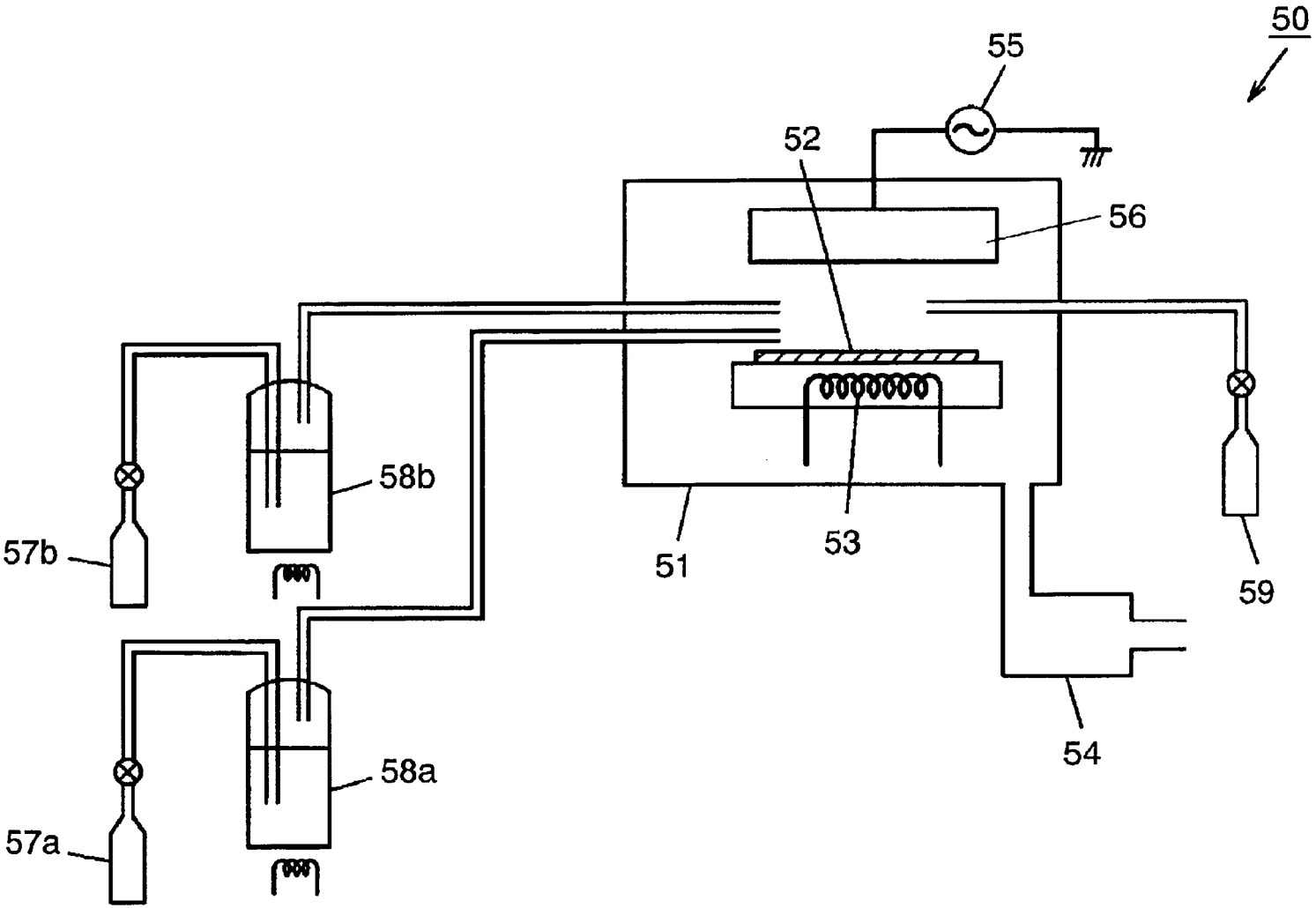
FIG. 3 is a schematic view of a CVD apparatus for fabricating the PDP according to the embodiment.

FIG. 3 is a schematic view of a CVD apparatus for depositing a metal oxide film on the float glass substrate.

The CVD apparatus 50 is applicable to thermal CVD process and plasma CVD process and has a heater 53 in a main CVD chamber 51 for heating a glass substrate 52 (the front glass substrate 11 shown in FIG. 1). The main CVD chamber 51 is depressurized by an exhausting device 54. An electrode 56 connected to a high-frequency power source 55 is provided in the main CVD chamber 51 for producing plasma.

Ar gas containers 57*a* and 57*b* supply Ar gas, carrier, via two bubblers 58*a* and 58*b* to the main CVD chamber 51. The bubblers 58*a* and 58*b* heat and store metal chelate, material for the metal oxide. The Ar gas from the Ar gas containers 57*a* and 57*b* vaporizes the metal chelate and is fed into the main CVD chamber 51.

The metal chelate employs acetyl acetone zirconium [$Zr(C_5H_7O_2)_2$] or zirconium dipivabroyl methane [$Zr(C_{11}H_{19}O_2)_2$]. The metal chelate may employ acetyl acetone including Al, Si, Sn, Sb, Ba, In, Hf, Zn, or Ca instead of Zr in the above chelate, or other metal oxide, e.g. dipivabroyl methane.

An oxygen ($O_2$) gas container 59 supplies reacting gas of $O_2$ to the main CVD chamber 51.

The CVD apparatus starts its thermal CVD operation with placing the glass substrate 52 with its dielectric layer side up on the heater 53. The glass substrate 52 is heated up to a predetermined temperature (250° C.) while the main CVD chamber 51 is depressurized to some tens Torr by the exhausting device 54.

For developing $Zr_2$ from acetyl acetone zirconium, for example, the bubbler 58*a* is used for filling the main CVD chamber 51 with the Ar gas from the Ar gas container 57*a*. For developing $Al_2O_3$ from aluminum dipivabroyl methane, the bubbler 58*b* is used for filling the main CVD chamber 51 with the Ar gas from the Ar gas container 57*b*. The metal chelate, source material, is heated up while the Ar gas is supplied from the Ar gas container 57*a* or 57*b*. The $O_2$ gas is supplied from the oxygen gas container 59 simultaneously. The gas reacts with the chelate for forming metal oxide on the glass substrate 52 in the main CVD chamber 51.

The plasma CVD process can be conducted with the CVD apparatus similarly to the thermal CVD process. The glass substrate 52 is heated by the heater 53 to 250° C. and excited with a high-frequency electric field of 13.56 MHz generated by the high-frequency power source 55 in the main CVD chamber 51 depressurized to 1330 Torr (176.89 kPa) by the exhausting device 54. This arrangement forms the metal oxide in the main CVD chamber 51 remaining in the plasma. The chelate may be mixed if a composite film of oxide is desired.

A dense metal oxide film is formed by the thermal CVD or plasma CVD process. The material gas is mixture of tetra-ethoxy tin titanium acetyl acetone and oxygen gas for forming the metal oxide of $SnTiO_4$.

(3) Dip Coating Method

Figure 4:
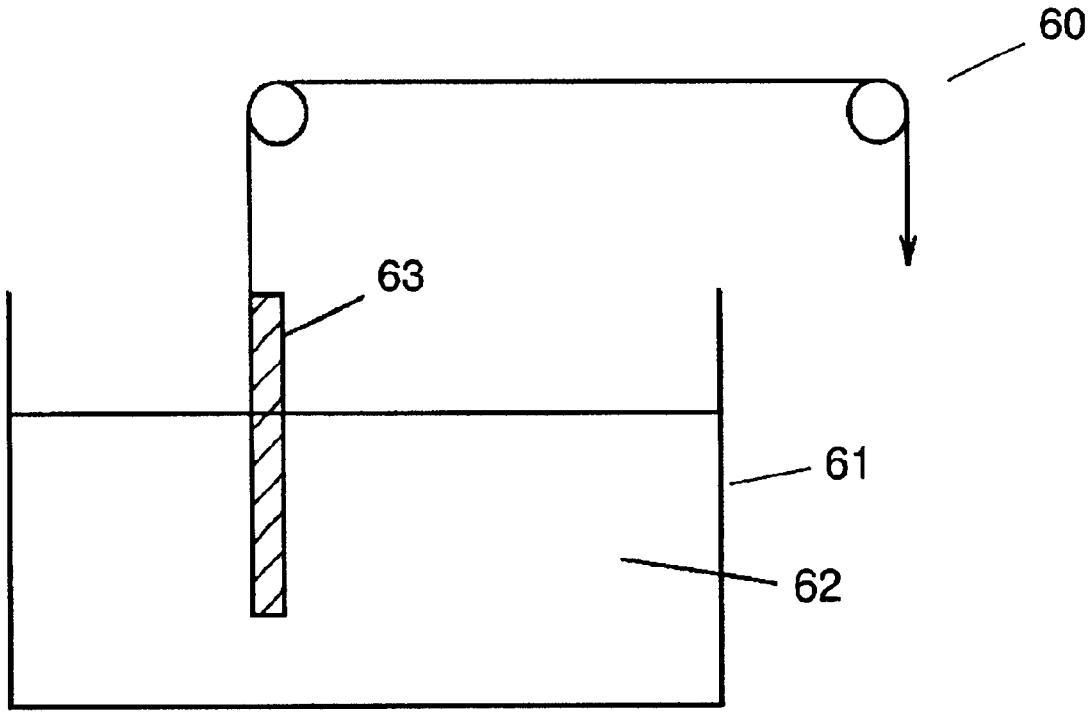
FIG. 4 is a schematic view of a dip-coating apparatus for fabricating the PDP according to the embodiment.

FIG. 4 is a schematic view of a dip coating apparatus for developing a metal oxide film on the glass substrate containing alkali fabricated by the floating method.

The dip coating apparatus 60 has a dip coating chamber 61 filled with (dipping) solution 62 prepared by dissolving a metal chelate (e.g. acetyl acetone or alcoxide) into organic solvent. A glass substrate 63 is dipped into the solution 62, dried, and baked to develop a metal oxide film thereon.

The metal chelate employs acetyl acetone zirconium, zirconium dipivabroyl methane, or zirconium alcoxide. The acetyl acetone metal chelate may be a metal expresses by $M[(C_5H_7O_2)_2]$ (where M is Zr, Al, Ti Zn, or Si). The dipivabroyl methane metal chelate may be a metal expressed by $M[(C_{11}H_{19}O_2)_2]$ (where M is Zr, Al, Ti, Zn, Si, Sn, Mo, W, Ta, Hf, Sb, or In).

The organic solvent employs alcohols such as ethyl alcohol or butyl alcohol. A baking temperature preferably ranges from 400° C. to 600° C.

The metal oxide film may include at least one of aluminum oxide ($Al_2O_3$), titanium oxide ($TiO_2$), zirconium oxide ($ZrO_2$), niobium oxide ($Nb_2O_3$), tin oxide ($SnO_2$), antimony oxide ($Sb_2O_3$), indium oxide ($In_2O_3$), hafnium oxide ($HfO_2$), tantalum oxide ($Ta_2O_5$), and zinc oxide (ZnO).

Alternatively, the metal oxide film may include oxide containing tetravalent tin. The oxide is a solid solution including MgO, CaO, SrO, BaO, $TiO_2$, $SiO_2$, or $SnO_2$. More particularly, characteristic examples of the tetravalent tin contained oxide are tin titanate (SnTiO4), tin silicate (SnSiO2), magnesium stannate (MgSnO3), calcium stannate (CaSnO3), strontium stannate (SrSnO3), and barium stannate (BaSnO3).

The metal oxide film may include different metal oxide layers accumulated thereon. A lower layer of the metal oxide film contains at least one of $Al_2O_3$, $TiO_2$, $ZrO_2$, $Nb_2O_3$, $SnO_2$, $Sb_2O_3$, $In_2O_3$, $HfO_2$, $Ta_2O_5$, ZnO, $SnTiO_4$, $SnSiO_2$, $MgSnO_3$, $CaSnO_3$, $SrSnO_3$, and $BaSnO_3$ and is covered with an upper layer of $Al_2O_3$ or $SiO_3$.

The metal oxide such as $ZrO_2$, $Al_2O_3$, $TiO_2$, ZnO, $SnO_2$, $Ta_2O_5$, $HfO_2$, $Sb_2O_5$, and $In_2O_3$ has a thermal expansion coefficient of $70\times10^{-6}$ to $90\times10^{-6}$ (1/° C.), which is close to that of the glass substrate containing Na of $80\times10^{-6}$ (1/° C.) fabricated by the floating method. The metal oxide film has a thickness ranging preferably from 0.1 to 1.0 $\mu$m.

The discharge electrode 12 is aligned on the metal oxide film formed on the front glass substrate 11. Two procedures of providing the discharge electrode 12 will be explained referring to FIGS. 5A and 5B.

Figure 5A:
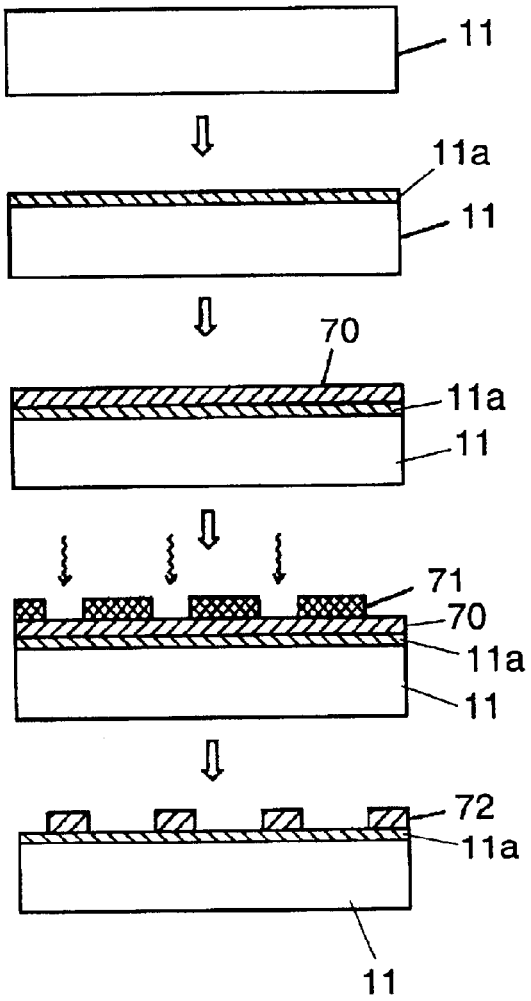
FIGS. 5A and 5B are flowcharts showing a procedure of providing an electrode of the PDP according to the embodiment.

In a procedure shown in FIG. 5A, a metal oxide layer 11*a*, including one or two layers, having a thickness of 0.1 to 1 $\mu$m on the front glass substrate 11 by a sputtering, CVD, or dip coating method. Then, the metal oxide layer has a surface coated with photosensitive Ag paste 70, is provided with a mask 71, and is subjected to exposure, development, and etching steps of a photolithographic process in order to form a desired pattern of Ag electrodes. The Ag electrodes are then baked to develop metal electrodes 72 functioning as the display electrodes.

Figure 5B:
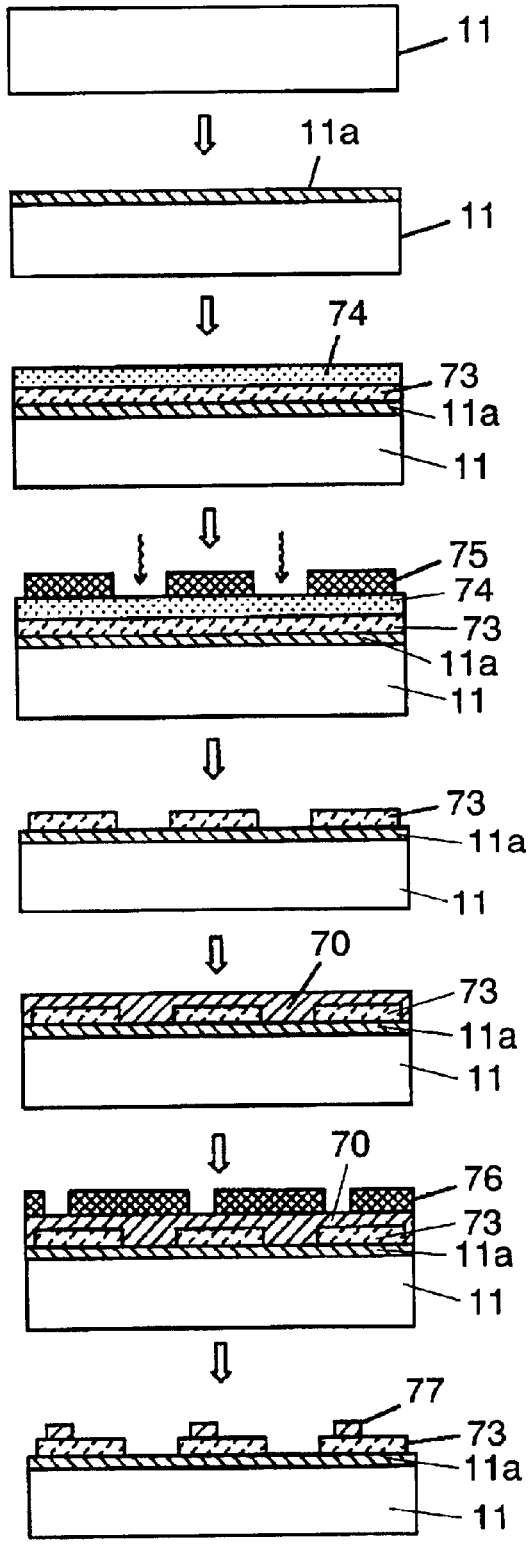

In a procedure shown in FIG. 5B, a metal oxide layer 11*a*, including one or two layers, having a thickness ranging from 0.1 to 1 μm is formed on the front glass substrate 11 by a sputtering, CVD, or dip coating method. Then, the metal oxide layer has a surface coated with an indium-tin oxide (ITO) transparent, an electrically conductive layer 73 of 0.1 to 0.2 μm thick by sputtering. Then, the conductive layer 73 is coated with a resist 74, provided with a masking 75, and subjected to exposure, development, and etching steps of a photolithographic process in order to form a desired pattern. Then, similarly to the steps shown in FIG. 5A, the transparent, electrically conductive layer 73 has a surface coated with a photosensitive Ag paste 70, is provided with a masking 76, and is subjected to exposure, development, and etching steps of a photolithographic process in order to form a desired pattern of Ag electrodes. The Ag electrodes are then baked to develop bus electrodes 77 functioning as the display electrodes.

Alternatively, those electrodes may be patterned by any appropriate patterning method such as transfer printing.

The dielectric glass layer 13 is developed by the following procedure on the front glass substrate 11 coated with the metal oxide layer and the discharge electrodes 12.

Glass material, e.g. PbO—$B_2O_3$—$SiO_3$—CaO glass having a thermal expansion coefficient of $78\times10^{-6}$ (1/° C.) is ground into particles of average diameters of 1.5 μm in a jet mill. Then, 35 to 70 weight % of the glass particles is mixed in a jet mill with 30 to 65 weight % of binder containing terpineol, butyl carbitol acetate, or pentane-diol containing 5 to 15 weight % of ethyl cellulose to provide paste for die-coating. The paste is doped with 0.1 to 3.0 weight % of detergent to decrease deposition but to increase the dispersibility of the glass particles.

Then, the die coating paste is applied by printing or die coating onto the glass substrate 11 and the electrodes 12, is dried, and is baked at a temperature of 550 to 590° C. which is slightly higher than the softening point of glass.

A procedure of sputtering the protective layer 14 will be described. The sputtering may be performed with a sputtering apparatus substantially identical to that shown in FIG. 2. The sputtering apparatus shown in FIG. 2 has a target 47 of magnesium oxide (MgO) or Mg provided as the material of the protective layer in a main sputtering chamber 41 which is then filled with reactive gas of $O_2$ supplied from an oxygen gas container 49.

In the sputtering procedure with the sputtering apparatus, first, a glass substrate 42 with its dielectric layer side up is placed on a heater 43 and heated to a specific temperature (250° C.) while the main sputtering chamber 41 is depressurized to substantially $10^{-3}$ Torr by an exhausting device 44. Then, the main sputtering chamber 41 is fed with Ar gas and excited with a high-frequency electrical field at 13.56 MHz generated by a high-frequency power source. Through accordingly sputtering MgO or Mg, the protective layer 14 of MgO is formed in the main sputtering chamber 41. The protective layer 14 of MgO of 1.0 μm thickness is formed by the sputtering according to this embodiment.

A procedure of fabricating the back panel 20 will be described.

First, by the same procedure as that for the metal oxide film and the Ag electrodes on the front glass substrate, address electrodes 22, second electrodes, on the back glass substrate 21. The address electrodes 22 are then covered with a white, dielectric glass layer 23, similarly to the front panel 10, which includes glass particles of 1.5 μm average diameter and titanium oxide ($TiO_2$) having an average particle diameter of 0.1 to 0.5 μm. The white, dielectric glass layer 23 or the dielectric ink paste is prepared by the same procedures as for the dielectric glass of the front panel. The white, dielectric glass layer 23 is baked at a temperature of 540 to 580° C.

Then the barriers 24 are provided at an equal interval of a desired distance by a screen printing method or a sand blasting method. Then, each space between the barriers 24 is provided with a phosphor layer 25, where each set of red (R), green (G), and blue (B) phosphors are arranged in an array. While the R, G, and B phosphor layers 25 may be made of phosphor materials used in the conventional PDPs, the following phosphors are preferable.

Red phosphor layer: $Y_2O_3:Eu^{3+}$

Green phosphor layer: $Zn_2SiO_4$:Mn

Blue phosphor layer: $BaMgAl_{10}O_{17}:Eu^{2+}$

Figure 6:
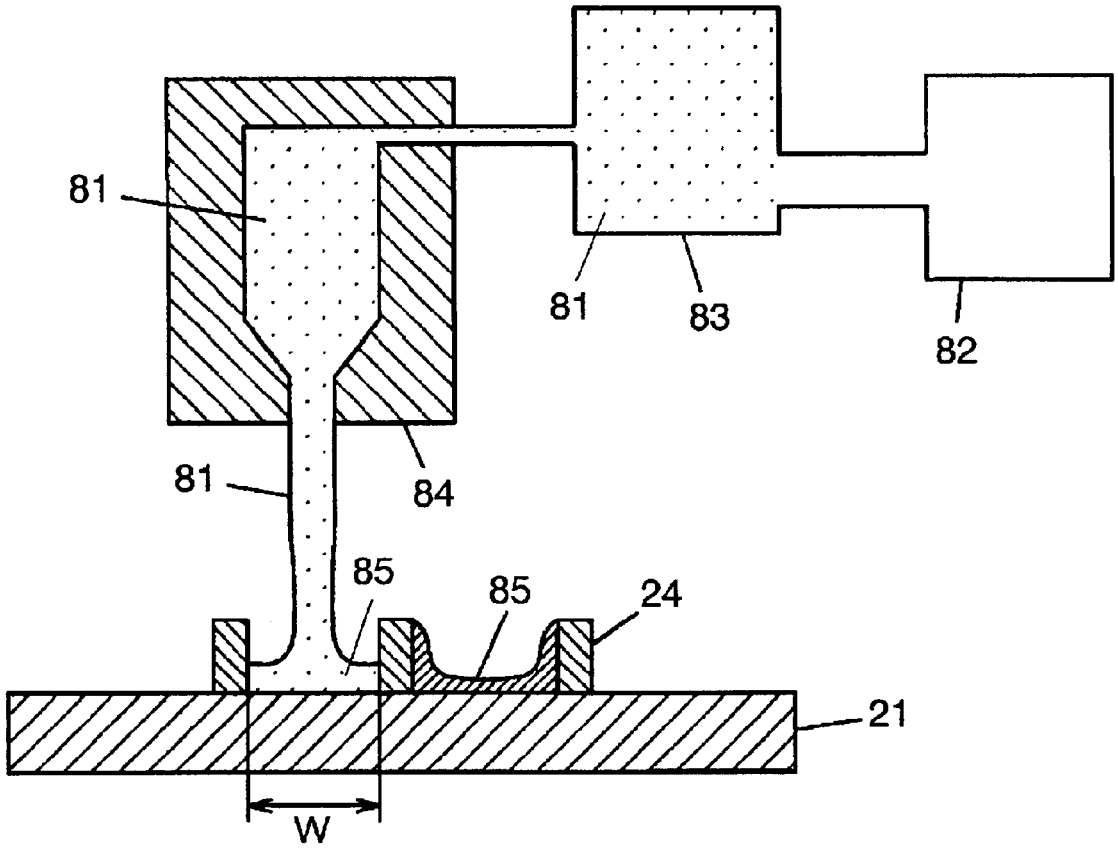
FIG. 6 is a schematic view of a phosphor application apparatus for fabricating the PDP according to the embodiment.
Figure 7:
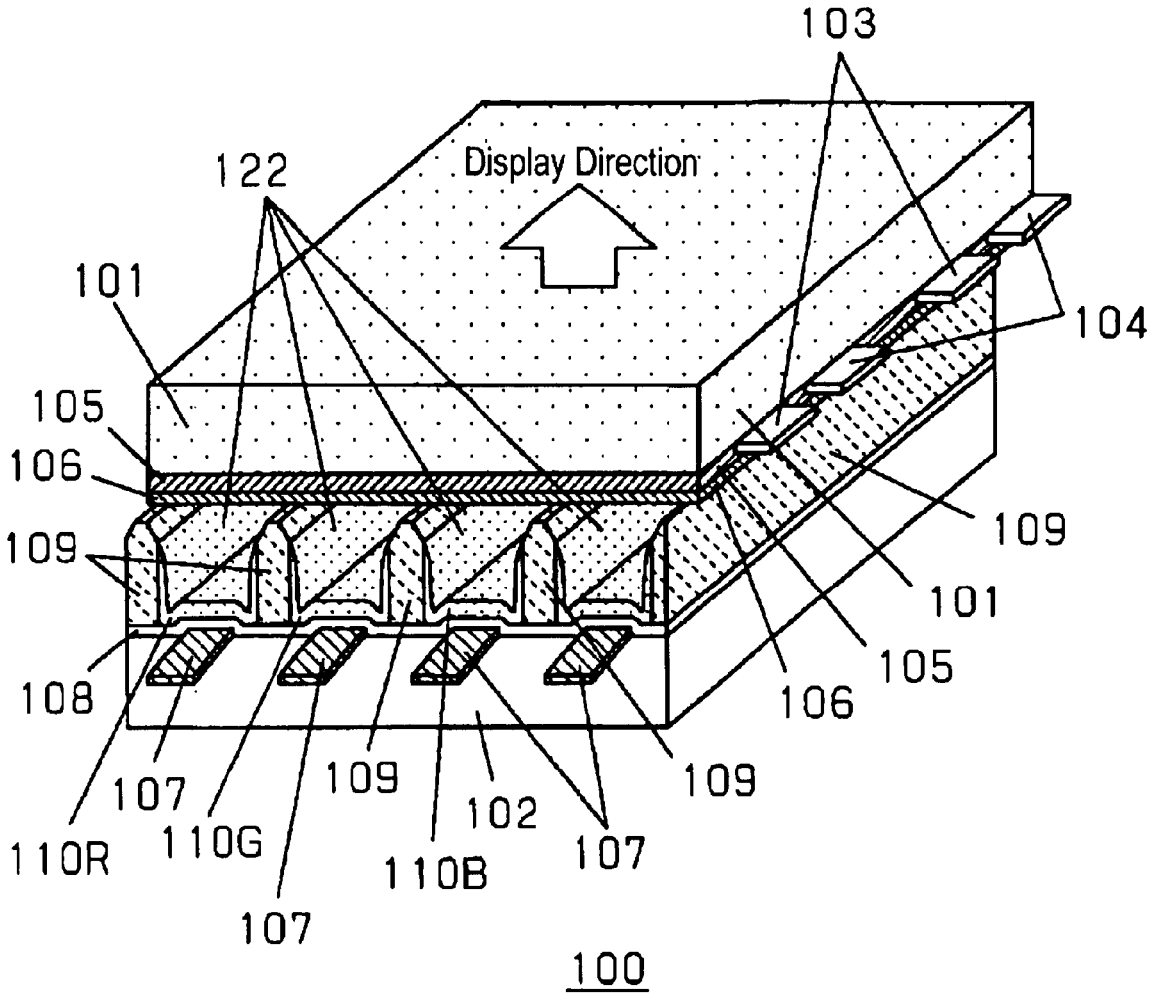
FIG. 7 PRIOR ART
FIG. 7 is a partial cross sectional perspective view showing a structure of an image display section of a PDP.
Figure 8:
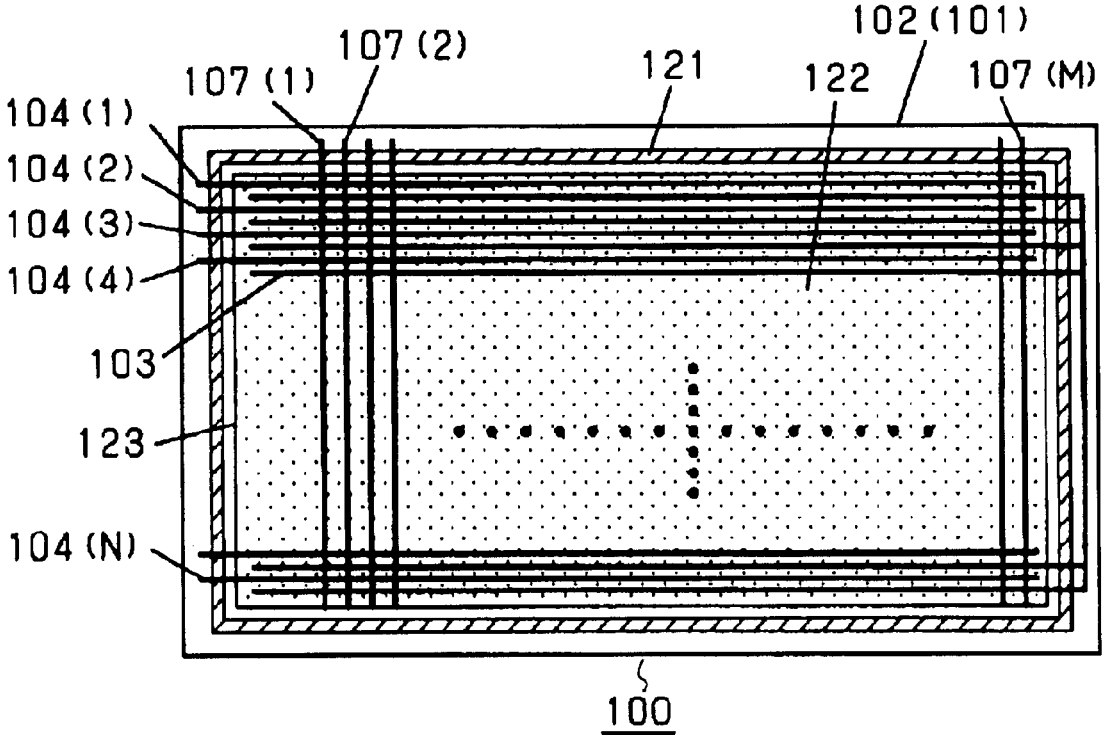
FIG. 8 PRIOR ART
FIG. 8 is a plan view of the PDP with a front glass substrate excluded.
Figure 9A:
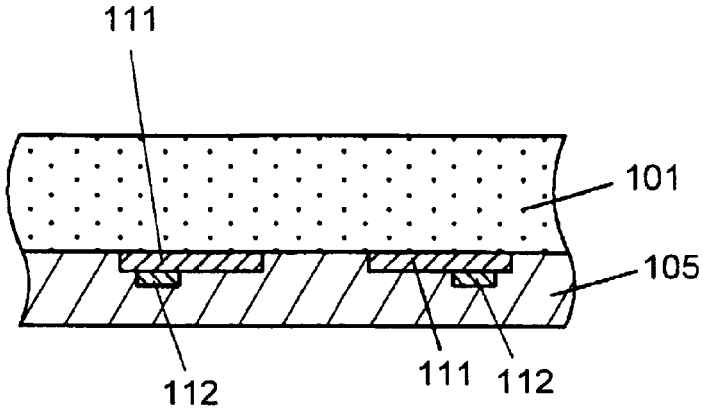
FIG. 9A PRIOR ART
FIGS. 9A and 9B are cross sectional views of a conventional PDP.
Figure 9B:
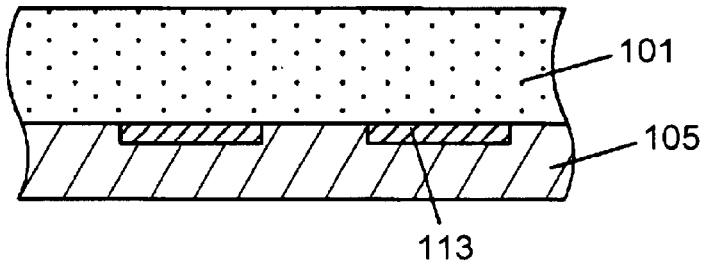
FIG. 9B PRIOR ART
Figure 10:
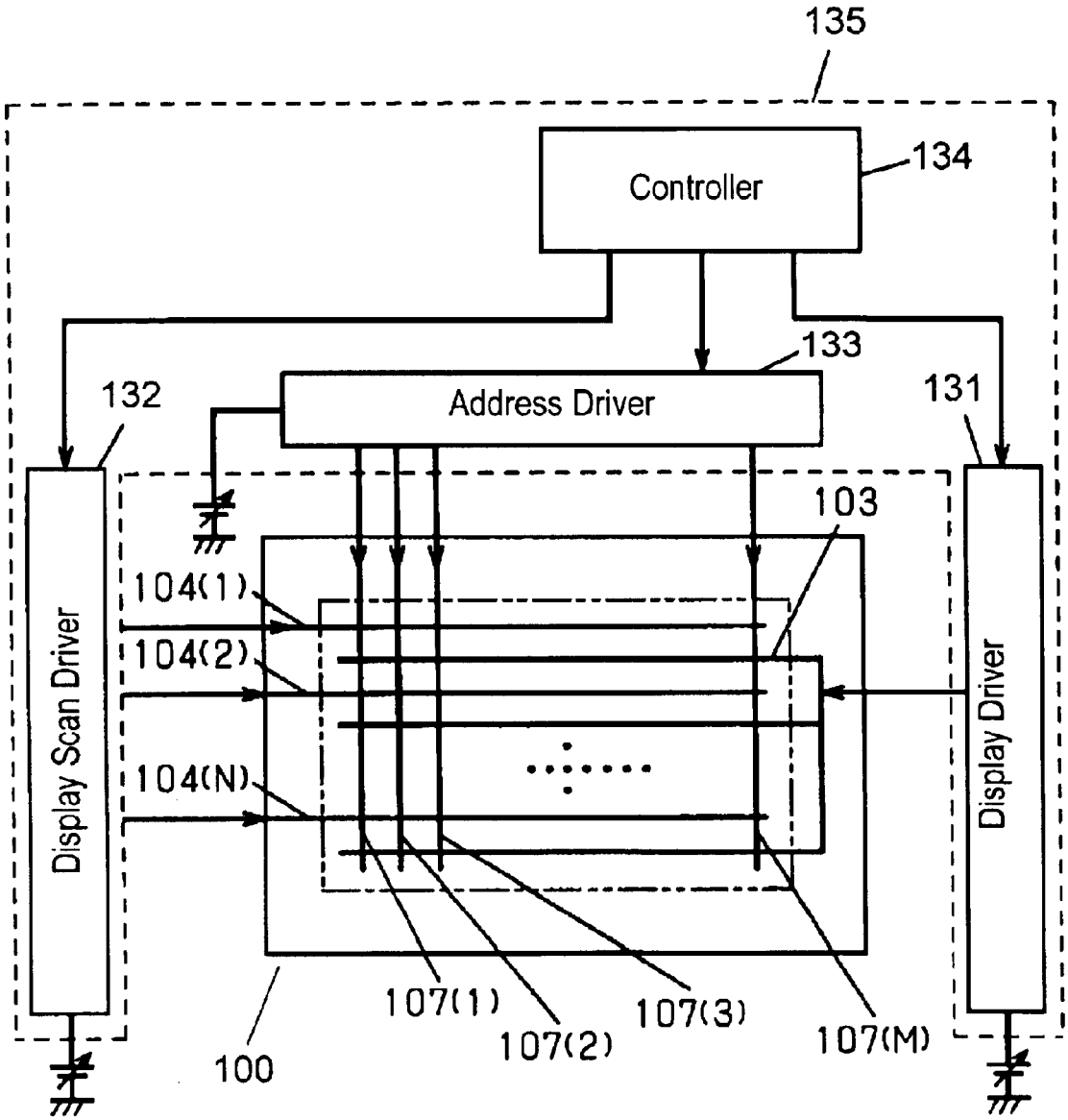
FIG. 10 PRIOR ART
FIG. 10 is a block diagram of a display apparatus with the PDP.
Figure 11A:
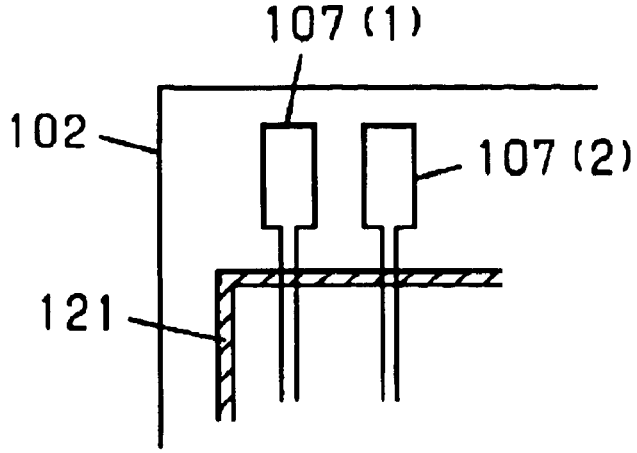
FIG. 11A PRIOR ART
FIGS. 11A and 11B are plan views showing a primary part of the conventional PDP.
Figure 11B:
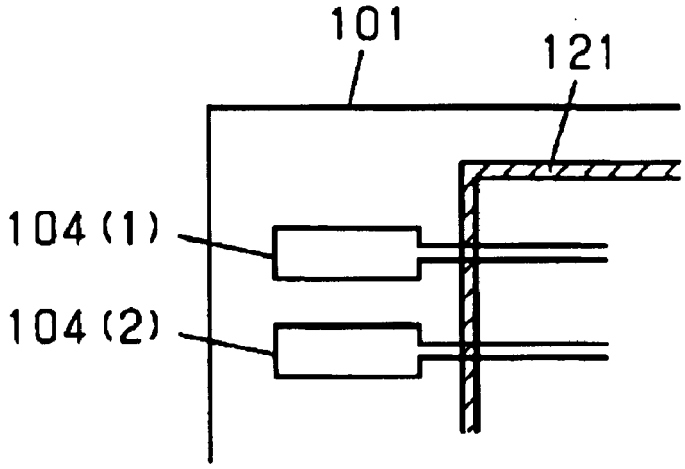
FIG. 11B PRIOR ART

A procedure of fabricating the phosphor layer 25 between the two barriers 24 will be described in more detail with referring to FIG. 6. 50 weight % of $Y_2O_3:Eu^{3+}$ powder, red phosphor particles each having an average particle diameter of 2.0 μm, 5.0 weight % of ethyl cellulose, and 45 weight % of solvent (α-terpineol) to provide coating solution 81 of 1.0 Pa·s (pascal·sec) which is then stored in a server 82. The coating solution 81 is ejected from a nozzle 84 having a nozzle diameter of 60 μm of an ejector by a pressure of a pump 83 and delivered in each space shaped in a strip between the barriers 24. As the substrate moves linearly, a line of the red phosphor 85 is formed. Similarly to this, a blue phosphor line 85 ($BaMgAl_{10}O_{17}:Eu^{2+}$) and a green phosphor line 85 ($Zn_2SiO_4$:Mn) are formed, Then, the glass substrate 21 is baked at 500° C. for ten minutes to provide the phosphor layers 25.

The front panel 10 and the back panel 20 are bonded and sealed at their rim to each other by sealing glass. Discharge space 30 defined between the barriers 24 is exhausted to a high vacuum of $1\times10^{-4}$ Pa and filled with discharge gas at a specific pressure, hence providing the PDP.

The PDP provided in above is prevented from a crack since including the lower layers of the display electrodes and the address electrodes, the lower layers which have a thermal expansion coefficient close to that of the glass substrate made by the floating method. Having the surface coated with the metal oxide film to improve the bonding between the electrode layer and the metal oxide or the dielectric glass, the glass substrate contains Na and Sn ions prevented from escaping. Therefore, the panel is prevented from the migration of Ag in operation. More specifically, the PDP of the embodiment is free from yellowish tint and color change by a b-value of −1.6 to −1.0 in a color difference meter resulting from the deposition of Ag.

The PDP of the embodiment, which is applicable to a 40-inch screen of the SXGA format, has a cell pitch of 1.16 mm, a distance d of 0.1 mm between the discharge electrodes 12, a distance of 80 μm between inner terminals for lead electrodes between the address electrodes, and a distance of 250 μm between inner terminals for lead electrodes between the discharge electrodes. The discharge gas used is of Ne—Xe type which have been used. The discharge gas which contains not smaller than 5 volume % of xenon and applied with a pressure of 66.5 to 100 Kpa improves intensity of lighted cells.

As set forth above, the PDP of the embodiment has the electrodes patterned on the metal oxide film formed on the glass substrate, thus being prevented from the migration of Ag from the electrodes, and eliminating any yellowish tint in the glass substrate. Accordingly, the PDP is improved in an operational reliability and enhanced in a color temperature.

FIG. 12 illustrates characteristics of the PDP of the embodiment. Samples 1 to 32 of the PDP of the embodiment was provided with the discharge electrodes, metal electrodes containing at least Ag formed on the metal oxide layer or the transparent conductive layer. The electrodes were covered with the dielectric glass layer of 20 to 40 μm thickness which was fabricated by die-coating a dielectric glass paste or printing and by baking. For use in a 42-inch screen SXGA display unit, the PDP had a height of 0.15 mm of each barrier 24, the distance (cell pitch) of 0.16 mm between the barriers 24, and a distance d of 0.10 mm between the discharge electrodes 12. The filling gas of Ne—Xe type contained 5 volume % of xenon and was maintained at a pressure of 75 KPa (560 Torr). The protective layer 14 of MgO was provided by sputtering.

Samples 1 to 32 of the PDP shown in FIG. 12 include the dielectric glass layer of the front panel made of PbO—$B_2O_3$—$SiO_2$—CaO glass and the dielectric glass layer of the back panel made of the PbO—$B_2O_3$—$SiO_2$—CaO glass doped with titanium oxide ($TiO_2$). Resultant effects are identical to those of the panel including the dielectric glass of either $Bi_2O_3$ type or ZnO type.

(Experiment 1)

Samples 1 to 32 of the PDP were tested for lighting. A voltage between the display electrodes (maintain electrodes) was 180V, and a voltage between the address electrodes was 80V. The panel lighting test was conducted at a temperature of 60° C. in a relative humidity of 95%. After 100 hours of the lighting, there were examined whether the migration of Ag was present or not and whether a withstand voltage was declined or not.

As apparent from the result of the migration between the display electrodes and the migration between the address electrodes of Samples 1 to 32 of samples of the PDP according to the embodiment (Samples 1 to 15 and 17 to 31) exhibited no migration of Ag and no defect in the withstand voltage (insulation defect). However, samples of the conventional PDP (Samples 16 and 32) exhibited the Ag migration and defects in the withstand voltage after 100 hours of the lighting.

(Experiment 2)

Samples 1 to 32 of the PDP were measured, with a color difference meter (NF777, Nippon Denshoku Kogyo), in an a-value and the b-value of tint degree (JIS Z8730) of the glass substrate, which includes the dielectric glass layer on the first electrodes and contributes significantly to the quality of displayed images. The a-value shifts to a positive direction, and a red color is accordingly emphasized. The a-value shifts to a negative direction, and a green color is accordingly emphasized. The b-value shifts to a positive direction, and a yellow color is accordingly emphasized. The b-value shifts to a negative direction, and a blue color is accordingly emphasized. At a-value ranging from −5 to +5 and the b-value ranging from −5 to +5, no undesired color change or yellowish tint is not observed in the glass substrate. Particularly at the b-value exceeding 10, the yellowish tint is significantly observed. A color temperature of the screen displaying a white color entirely was measured with a multi-channel spectrometer (MCPD-7000, Otsuka Denshi Ltd.).

Resultant measurements of the a-value and the b-value of the front glass substrate as well as the color temperature of samples 1 to 32 of the PDP are shown. In the PDPs according to embodiment, the b-values are low, −1.6 to +1.0, thus exhibiting a low yellowish tint and almost no color change, while the b-values of the conventional PDPs (Samples 16 and 32) are +5.5 and +16.3. The PDPs according to the embodiment exhibit color temperatures are high, i.e. ranging from 9100 to 9500° K, hence having an improved color reproducibility, and displaying images more brilliant, while the conventional PDPs (Samples 16 and 32) exhibit color temperatures of 7250° K and 6450° K.

What is claimed is:

1. A plasma display panel comprising:

a first panel including:

a glass substrate having a first surface and fabricated by a floating method; and a metal oxide layer provided on said first surface of said glass substrate;

a second panel facing said first panel to form a discharge space between said first panel; and a first electrode containing Ag provided on said glass substrate.

2. A plasma display panel according to claim 1, wherein said metal oxide layer contains at least one of aluminum oxide ($Al_2O_3$), titanium oxide ($TiO_2$), zirconium oxide ($ZrO_2$), niobium oxide ($Nb_2O_3$), tin oxide ($SnO_2$), antimony oxide ($Sb_2O_3$), indium oxide ($In_2O_3$), hafnium oxide ($HfO_2$), tantalum oxide ($Ta_2O_5$), and zinc oxide (ZnO).

3. A plasma display panel according to claim 1, wherein said metal oxide layer contains oxide including tetravalent tin.

4. A plasma display panel according to claim 3, wherein said oxide contains one of MgO, CaO, SrO, BaO, $TiO_2$, and solid solution of $SiO_2$ and $SnO_2$.

5. A plasma display panel according to claim 3, wherein said oxide contains at least one of tin titanate (SnTiO4, tin silicate ($SnSiO_2$), magnesium stannate ($MgSnO_3$), calcium stannate ($CaSnO_3$), strontium stannate ($SrSnO_3$), and barium stannate ($BaSnO_3$).

6. A plasma display panel according to claim 1, wherein said metal oxide layer includes:

a first metal oxide layer provided on said first surface of said glass substrate; and a second metal oxide layer provided on said first metal oxide layer.

7. A plasma display panel according to claim 6, wherein said first metal oxide layer contains at least one of $Al_2O_3$, $TiO_2$, $ZrO_2$, $Nb_2O_3$, $SnO_2$, $Sb_2O_3$, $In_2O_3$, $HfO_2$, $Ta_2O_5$, ZnO, $SnTiO_4$, $SnSiO_2$, $MgSnO_3$, $CaSnO_3$, $SrSnO_3$, and $BaSnO_3$.

8. A plasma display panel according to claim 6, wherein said second metal oxide layer contains one of $Al_2O_3$ and $SiO_3$.

9. A plasma display panel according to claim 1, further comprising a dielectric layer on said first electrode.

10. A plasma display panel according to claim 1, wherein said second panel including:

a substrate having a first surface facing said first surface of said glass substrate;

a second electrode provided on said first surface of said substrate;

a plurality of barriers provided over said first surface of said substrate; and a phosphor layer provided over said second electrode and between said plurality of barriers.

11. A method of making a plasma display panels, comprising the steps of:

providing a first panel by forming, by one of a sputtering method and a chemical vapor deposition (CVD) method, a metal oxide layer on a first surface of a glass substrate fabricated by a floating method;

forming an electrode contaning Ag on the metal oxide layer; and providing a second panel over said first surface of said glass substrate to form a discharge cell over the metal oxide layer.

12. A method according to claim 11, further comprising forming a dielectric layer on said first electrode.

13. A method according to claim 11, wherein said second panel including:

a substrate having a first surface facing said first surface of said glass substrate;

a second electrode provided on said first surface of said substrate;

a plurality of barriers provided over said first surface of said substrate; and a phosphor layer provided over said second electrode and between said plurality of barriers.

14. A method of making a plasma display panels, comprising the steps of:

forming a metal oxide layer on a first surface of a glass substrate fabricated by a floating method;

forming a transparent electrode layer on the metal oxide layer by a sputtering method;

patterning the transparent electrode layer to form a transparent electrode;

forming a first electrode with photosensitive silver material on the transparent electrode; and disposing a second panel to face the first surface of the a lass substrate to form a discharge cell between the first and second panels.

15. A method according to claim 14, wherein said step of forming the transparent electrode includes the sub-step of patterning the transparent electrode layer by a photolithographic method to form the transparent electrode.

16. A method according to claim 14, wherein said step of forming the electrode includes the sub-step of forming the electrode with the photosensitive silver material on the transparent electrode by a photolithographic method.

17. A method according to claim 14, further comprising forming a dielectric layer on said first electrode.

18. A method according to claim 14, wherein said second panel including:

a substrate having a first surface facing said first surface of said glass substrate;

a second electrode provided on said first surface of said substrate;

a plurality of barriers provided over said first surface of said substrate; and a phosphor layer provided over said second electrode and between said plurality of barriers.

* * * * *

UNITED STATES PATENT AND TRADEMARK OFFICE

CERTIFICATE OF CORRECTION

PATENT NO. : 6,774,558 B2
DATED : August 10, 2004
INVENTOR(S) : Mitsuhiro Otani et al.

It is certified that error appears in the above-identified patent and that said Letters Patent is hereby corrected as shown below:

Column 10,
Line 53, "SnTiO4" should read -- $SnTiO_4$ --.

Column 11,
Line 21, "panels" should read -- panel --.

Column 12,
Line 5, "panels" should read -- panel --.
Lines 15-16, "a lass" should read -- glass --.

Signed and Sealed this

First Day of February, 2005

JON W. DUDAS
*Director of the United States Patent and Trademark Office*